United States Patent [19]

Jabben

[11] Patent Number: 4,461,934

[45] Date of Patent: Jul. 24, 1984

[54] CLICK DISC SWITCH ASSEMBLY

[75] Inventor: Gary D. Jabben, Shreveport, La.

[73] Assignee: AT&T Technologies, Inc., New York, N.Y.

[21] Appl. No.: 451,358

[22] Filed: Dec. 20, 1982

[51] Int. Cl.[3] ..... H01H 13/70

[52] U.S. Cl. ..... 200/5 A; 200/159 B

[58] Field of Search ..... 174/68.5; 200/5 R, 5 A, 200/159 B, 275, 292; 361/405, 406, 413

[56] References Cited

U.S. PATENT DOCUMENTS

| | | | |
|---|---|---|---|
| 3,952,174 | 4/1976 | Boulanger et al. | 200/5 A |
| 3,996,430 | 12/1976 | Eberwein et al. | 200/5 A |
| 4,005,293 | 1/1977 | Boulanger | 200/5 A |
| 4,045,636 | 8/1977 | Yader et al. | 200/5 A X |
| 4,046,981 | 9/1977 | Johnson et al. | 200/5 A X |
| 4,084,071 | 4/1978 | Smith | 200/5 A |
| 4,104,702 | 8/1978 | Armstrong | 200/5 A X |
| 4,123,627 | 10/1978 | Boulanger et al. | 200/5 A |
| 4,160,886 | 7/1979 | Wright et al. | 200/5 A |
| 4,392,181 | 7/1983 | Jabber | 361/406 X |

FOREIGN PATENT DOCUMENTS 1018873 2/1966 United Kingdom .

*Primary Examiner*—J. R. Scott
*Attorney, Agent, or Firm*—R. F. Kip, Jr.

[57] ABSTRACT

There is disclosed a click disc switch assembly comprising a plate-like base having on it copper foil paths including (a) "row" paths each including a respective row of contact pads in a row-and-column matrix of such pads on the base, and (b) "column" paths corresponding to the columns of the matrix and including respective bonding pads. Overlying the columns of the matrix are click disc strips having end tabs welded to the bonding pads. Interposed between the strips and the "row" paths is an originally liquid and subsequently solidified coating deposited on the base to cover portions of the row paths while leaving uncovered their contact pads. The base and the strips include holes used to align the latter on the former.

10 Claims, 7 Drawing Figures

CLICK DISC SWITCH ASSEMBLY

FIELD OF THE INVENTION

This invention relates generally to click disc switch assemblies providing an X–Y matrix of make-break switch contacts adapted to each be actuated by a respective one of the keys of a keyboard. More particularly, this invention relates to improved modes in such assemblies of securing the overlying members which carry the click discs to the underlying base member of the assembly, and to other improvements.

BACKGROUND OF THE INVENTION

Devices employing click-discs as contact elements in an X–Y matrix of switch contacts have been known for a number of years. For example, such a device for use with an electronic calculator keyboard is described in U.S. Pat. No. 4,005,293 issued Jan. 25, 1977 in the name of Henry J. Boulanger and incorporated herein by reference.

My U.S. Pat. No. 4,392,181 incorporated herein by reference discloses a click disc assembly comprising a planar molded plastic substrate and twelve contact dots of electroconductive ink arranged on such substrate in a 3×4 X–Y matrix consisting of four "X" rows of three contact dots each forming three "Y" columns. The dots in each of the four "X" rows are included in four corresponding paths of electroconductive ink deposited on the substrate and leading to four corresponding "row" terminal locations within a terminal region or zone at one end of the substrate. The dots in each row are thereby all electrically connected to a respective one of such locations.

Overlying the three "Y" columns of the matrix are three steel strips each having formed within its edges four click disks electrically connected to the edge portions of that strip and each disposed above a respective one of the four contact dots in that column. A thick insulating layer of, say, polyester tape separates the strips from the paths on the substrate except in areas beneath the click discs where the tape has holes therein to permit the discs to contact their underlying contact dots. Each click disc by touching such dot electrically couples the "column" strip of which the disc is a part to the "row" electroconductive path of which the dot is a part. The edge portions of the three column strips extend to the mentioned terminal zone on the substrate to have end tabs overlying three corresponding "column" terminal locations in that zone.

Within that zone, and prior to formation of the electroconductive paths on the substrate, L-shaped metal terminal pieces are inserted into apertures in the substrate at the "row" and "column" terminal locations so that one of the "L" arms of each terminal passes with a press fit through and then beyond such aperture to end in a tip outwardly salient from the substrate. The other terminal arm or head of the terminal lies flat on the substrate's upper surface. After such inserting, the "row" terminals are bonded and electrically coupled to the "row" electroconductive paths by deposition of the electroconductive ink of these paths to cover the flat heads of such terminals. The "column" terminals are, on the other hand, bonded and electrically coupled to the "column" strips by welding the mentioned end tabs of such strips through holes in the mentioned insulating layer to the flat heads of the "column" terminals. After the "row" and "column" terminals have been connected up as described in the click disc assembly, the outwardly projecting tips of the terminals are soldered to plated rectangular slots formed in a printed circuit card disposed below and spaced from the substrate board of the click disc assembly. In this manner, the X–Y switch contact matrix of such assembly is connected through the soldered terminals to operating circuitry on the printed circuit card to provide a complete telephone dial unit.

While click disc assemblies of the above described construction are satisfactory for many purposes, they have the disadvantage of requiring unsoldering of the terminals in order to remove an assembly for purposes of repair. Other disadvantages are that such assemblies are somewhat expensive to fabricate, and lack versatility in that they must be connected to underlying circuit boards or cards dimensioned to match with the particular click assembly being used.

SUMMARY OF THE INVENTION

One or more of the mentioned disadvantages are overcome by the present invention in one of its aspects by providing a click disk assembly in which the said base member of the assembly has at one edge thereof an array of terminal pads forming parts of the conductive paths on the base member, and permitting electrical connection of these paths by edge connectors to external circuitry. In order, however, to provide a good electrical connection between the terminal pads and the edge connectors clipped thereto the pads and other portions of the conductive paths on the base member are not provided (as in my previous construction) of electroconductive ink but, instead are provided by copper foil with or without thin layers of other metals plated thereon for protection purposes. Since the L-shaped rigid terminal pieces of the click disc assemblies of my previous construction have been replaced by terminal pads, it is no longer possible to secure the click disc strips as before (i.e., through such discrete terminal elements) to the base member. It has surprisingly been found, however, that, in accordance with such one aspect of the invention, the click disc strips can be directly secured to the printed wiring board (constituted of the base member and the copper foil paths thereon) by forming weld junctures of portions of such strips and portions of such paths.

According to the invention in another of its aspects the insulating tape used in my previous construction is replaced by a deposit on the printed wiring board of a coating which covers the entire board except in places where it is not needed or not wanted. The use of such coating instead of an insulating tape provides a saving of material, and the coating performs the triple functions of increasing the spacing of the click discs away from the contact dots lying beneath them insulating the click disc strips from the copper foil paths except at selected areas, and serving as a mask permitting layers of nickel and gold to be selectively plated on the printed wire board so as to cover the copper foil paths only in such areas.

As still another aspect of the invention, the base member and the click disc strips may be provided with registering aligning holes whereby the strips may be accurately positioned relative to the base member.

BRIEF DESCRIPTION OF DRAWINGS

For a better understanding of the invention, reference is made to the following description of an exemplary embodiment thereof and to the accompanying drawings wherein:

FIG. 5 showing such portion before such junction is formed, and the FIG. 5 view being somewhat idealized and being exaggerated and not to scale in its vertical dimensioning;

DESCRIPTION OF EMBODIMENT

Figure 1:
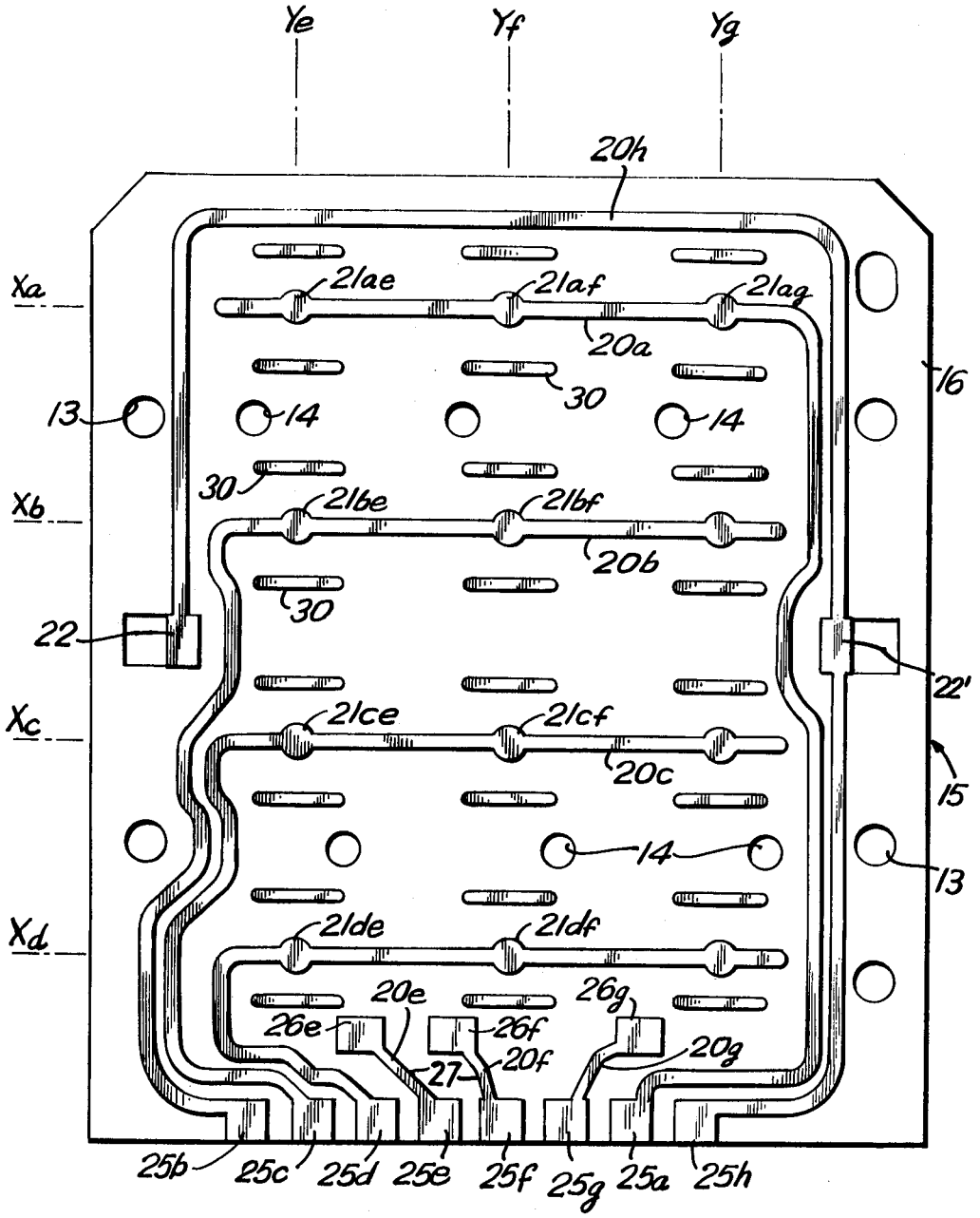
FIG. 1 is a plan view of the printed wiring board of a click disk switch assembly according to the invention.

Referring now to FIGS. 1–4, the reference numeral 10 designates (FIG. 2) a click disk assembly of which a component is (FIG. 1) a printed wiring board 15 comprising a substantially rectangular platelike base member 16 and a plurality of electroconductive paths 20 on the front surface of the board. Board 16 is constituted of laminated epoxy glass material and has apertures 13 therein for attaching the board by screws or the like to a support. The base member 16 is also perforated by aligning holes 14 used as later explained.

The paths 20 ae made of copper foil 19 and are each constituted of one or more electroconductive pads which are electrically continuous with narrower leads of copper foil. The copper foil in such paths is one ounce copper foil having a nominal thickness of 0.0014 inch. Such foil is bonded to base member 16 by a layer 18 of conventional adhesive material underlying only the paths 20. The various paths 20 are divided into four row conductors 20*a*–20*d*, three column conductors 20*e*–20*g* and a shield conductor 20*h*.

The four row conductors each include a respective row of three contact pads 21 in a 3×4 array of twelve of such pads arranged in rows X*a*–X*d* and columns Y*e*–Y*g* to form a switching matrix. For example, row conductor 20*a* includes contact pads 21*ae*, 21*af* 21*ag* which constitute the topmost row of pads in such matrix.

The three column conductors 20*e*–20*g* correspond to the three columns of the matrix, conductor 20*e*, for example, corresponding to the column of contact pads 21*ae*, 21*be*, 21*ce* and 21*de* which are in column Y*e* of the matrix. The manner in which each column conductor path 20 may be selectively coupled to any contact pad in the corresponding column will be later described.

The shield conductor 20*h* is not involved in the switching action of the matrix, such conductor being used to provide electrostatic shielding for the click disc assembly. Path 20*h* includes pad areas 22, 22'.

As shown, the eight electroconductive paths 20 include eight respective terminal pads 25 spaced from each other in a linear array thereof at the front edge of the base member 16. The three column paths 20*e*, 20*f*, 20*g* also include three respective bonding pads 26*e*, 26*f*, 26*g* spaced back from their corresponding terminal pads 25*e*, 25*f* and 25*g* and rendered electrically continuous therewith by copper foil lead portions 27 of such paths. Each of such bonding pads has the dimensions of 0.130 inch×0.100 inch.

In addition to the electroconductive paths 20, the base member 16 has thereon a plurality of pairs of bars 30 of copper foil 19. The bars in each such pair lie on opposite sides of a respective one of the contact pads 21 in the column in which that pad is located such that these bars are normal to and bisected by the centerline for that column. The purpose of bars 30 will be later explained.

The paths 20 and bars 30 are produced on base member 16 as follows. A sheet of one ounce copper foil is bonded to the base member by the layer 18 (FIG. 4) of conventional adhesive material. Resist material (not shown) is then applied by screening to the exposed surface of the sheet to cover only those portions of it corresponding to the desired paths 20 and bars 30. The uncovered part of the sheet is then etched away (and the remaining resist material removed) to leave behind on base member 16 the copper foil paths 20, the bars 30 and portions lying beneath each of these elements of the adhesive layer 18. The rest of such layer is dissolved in the course of such etching. As stated, the thickness of the copper foil in the paths 20 and bars 30 is normally 0.0014 inch, but such thickness has tolerance variations from such normal value.

With the paths 20 and bars 30 having been so formed, a solder resist material (which may, for example, be either the proprietary composition "M & T 310" sold by the M & T Chemical Company, Rahway, New Jersey on the proprietary composition "Unimask 2000" sold by the Industrial Polymer Division of W. R. Grace & Co., 55 Hayden Avenue, Lexington, Md.) is applied by silk screening to the front surface of the printed wiring board 15 to coat by a thin layer of such material all of such surface of the board except for the pad areas of the paths 20, holes 13, 14, pads 22, 22', and circular areas 34 (FIG. 2) concentrically surrounding the contact pads 21. When such thin layer has so been laid down, it is cured and solidified by ultra violet light to form a thin solid insulating coating 35 covering bars 30 and paths 20 except for the pad areas thereof and such holes and circular areas.

All those pad areas (and, also, the lead portions of paths 20 within apertures 34) then have deposited thereon by electroplating first a layer 36 (FIG. 4) of nickel of a nominal thickness of 0.00010 inch and, next, a top layer 37 of hard gold of a nominal thickness of 0.000025 inch. The gold of the gold plated areas prevents these areas from tarnishing to thereby assure that good ohmic contact can be made therewith at all times. The nickel layer 36 interposed between the gold layer 37 and the underlying copper foil 19 prevents migration of copper from the foil into the gold so as to diminish its value as an oxidizing resistant layer. Thus, the use of the nickel layer permits the gold layer to be made very thin to save expense. Moreover, the use of the described insulating coating 35 (in lieu of, say, a flexible sheet of insulating tape placed over the printed wiring board) causes board 15 to be gold plated only in certain parts thereof collectively small in area compared to the board's area. This provides the advantage of savings in the amount of gold used and, thereby, of expense.

Disposed on top of insulating coating 35 are (FIG. 2) three "column" or click disc strips 40*e*, 40*f*, 40*g* aligned in centered relation with, respectively, columns Y*e*, Y*f*, Y*g* of the switch matrix. Since strip 40*f* is identical with the other two strips, only that strip will be described in detail.

Figure 3:
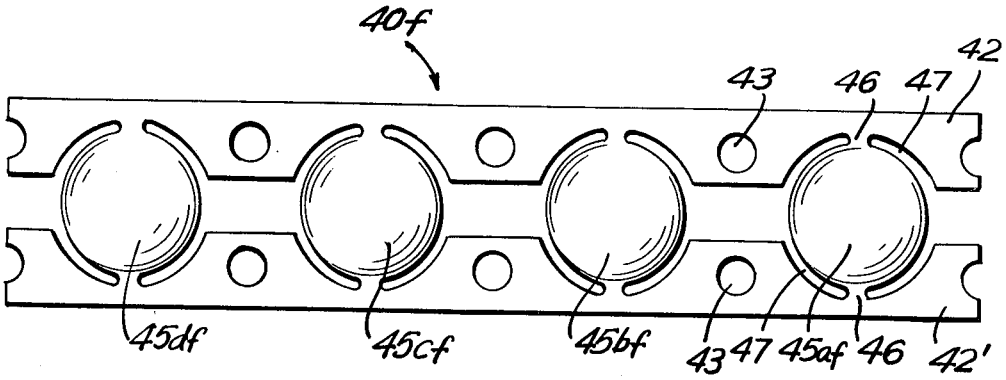
FIG. 3 is a plan view of the entirety of one of the column strips incorporated in the FIG. 2 assembly.
Figure 4:
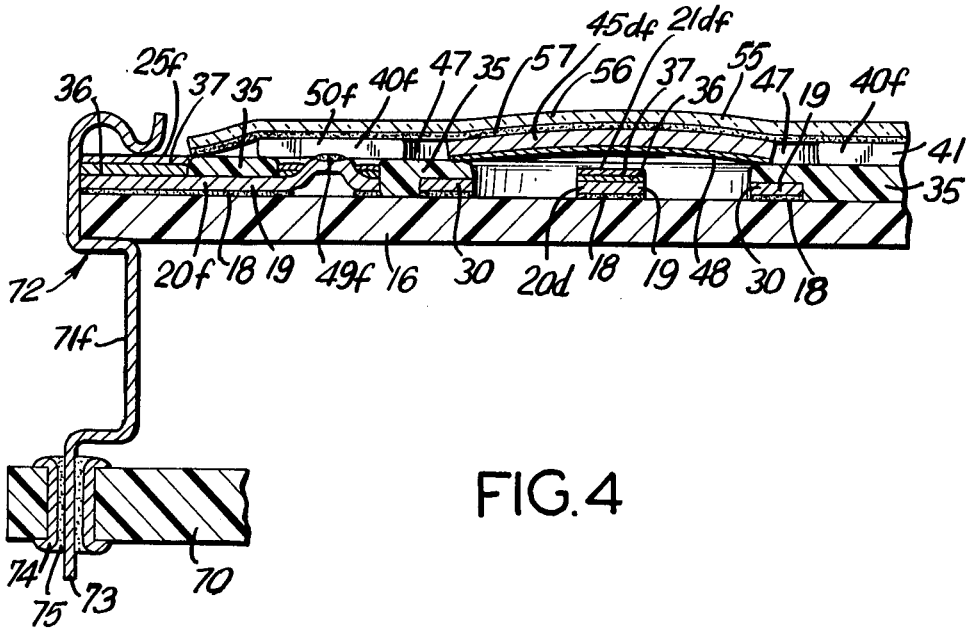
FIG. 4 is an enlarged schematic view in vertical cross section of part of the FIG. 2 assembly; taken as is shown by the arrows 4—4 and being exaggerated and not to scale in its vertical dimensioning.

As shown in FIG. 3, strip 40*f* is an elongated strip of corrosion resistant steel 41 which may be, say, modified 302 stainless steel. The strip has a nominal thickness of 0.0038 inch. The skeleton of strip 40*f* inludes two separated side portions 42, 42' on opposite sides of the strip. A plurality of aligning holes 43 are formed in portions 42, 42' to have the same pattern of relative locations as the aligning holes 14 in the printed wiring board 15. Also included in strip 40*f* are four click disks 45*af*, 45*bf*, 45*cf* and 45*df* joined to side portions 42, 42' by necks 46 of the steel material 41 of the strip, but otherwise separated from such side portions by arcuate slits 47. Such click discs are outwardly convex dome-shaped structures distributed along the length of strip 40*f* to have the same spacing between centers as that between the contact pads 21*af*, 21*bf*, 21*cf*, 21*df* on the printed wiring board 16. The inner surfaces (FIG. 4) of the mentioned click discs have thereon a layer 48 of gold plating.

As stated, click discs strips 40*e* and 40*g* are similar in structure to strip 40*f*. The three strips are placed in their respective columns Y*e*, Y*f*, Y*g* (FIG. 2) on the insulating coating 35 on board 15 such that the four click discs 45 in each strip are respectively centered over the four contact pads 21 in the corresponding column, and such that the aligning holes 43 in the strips register with the aligning holes 14 in the base member 16. When the strips are so positioned, they are separated by coating 35 from the underlying electroconductive paths 20 except within the areas coextensive with apertures 34 in the coating and the apertures therein over the bonding pads 26. Having been so positioned, the strips 40 are electrically coupled and mechanically secured to the printing wiring board 15 by junctions 49*e*, 49*f*, 49*g* made by welding of the bonding pads 26*e*, 26*f*, 26*g* on the board to overlying end tabs 50*e*, 50*f*, 50*g* on the strips. Such junctions and the manner of making them will be described in further detail hereafter. By virtue of the click disc strips being so electrically coupled to the mentioned bonding pads, they are thereby coupled to the "column" electroconductive paths 20*e*, 20*f*, 20*g* and to the terminal pads 25*e*, 25*f*, 25*g* included therein.

Figure 2:
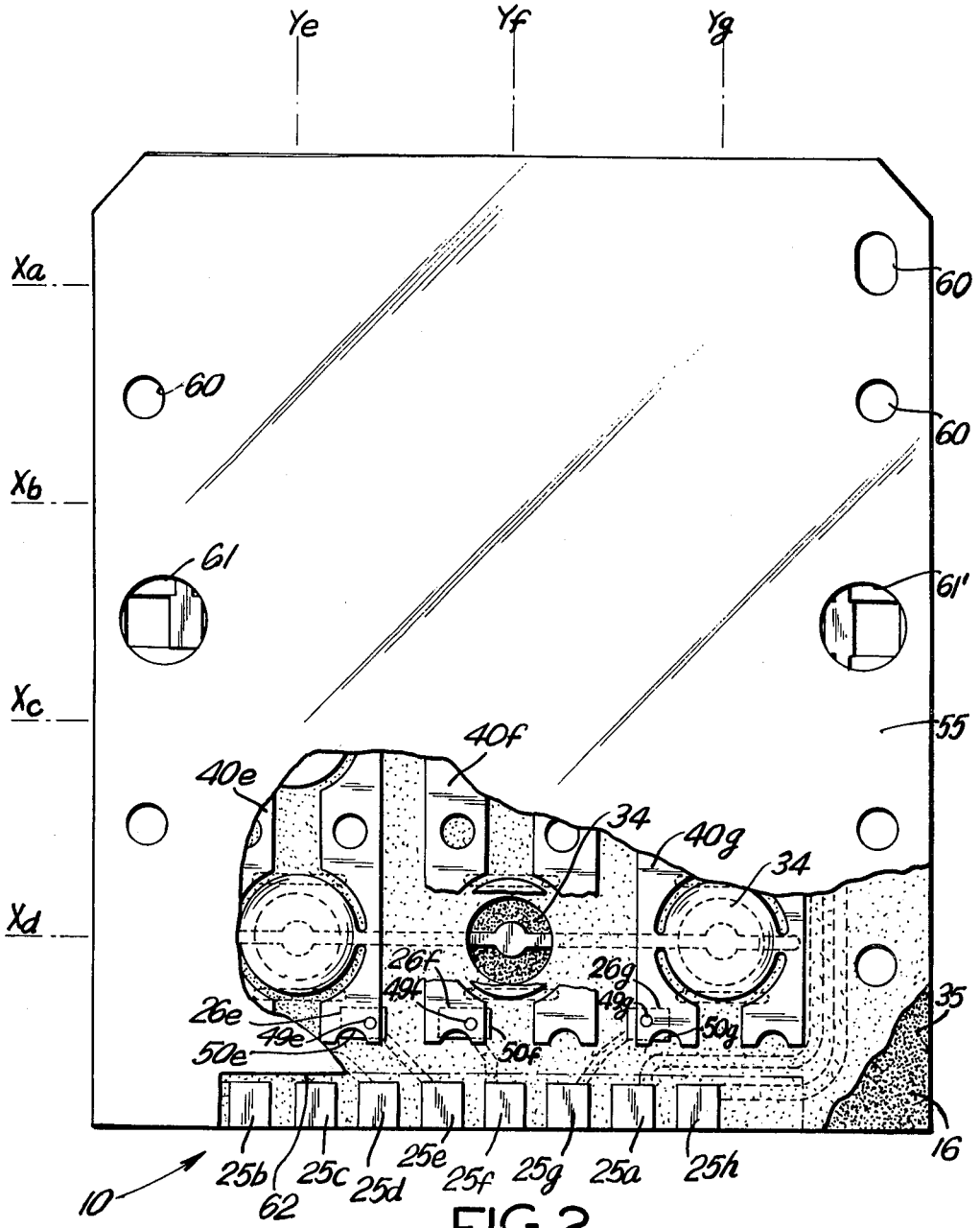
FIG. 2 is a plan view of such assembly as completed with parts of such assembly being broken away.

The structure of the click disc assembly 10 is completed by covering it with a seal 55 in the form of a polyester sheet 56 having on its underside an adhesive layer 57 by which the seal is bonded to the click disc strips 40 and (outside the areas of such strips) to the coating 35. Seal 55 is transparent but, for convenience, is shown in FIG. 2 as being opaque. The seal has formed therein apertures 60 registering with the apertures 13 in the board 15, apertures 61, 61' registering with the pads 22, 22' in the shield conductor path 20*h* and a rectangular slot 62 disposed at the front edge of board 15 so as to leave exposed to access the terminal pads 25 of the board.

The described assembly 10 is used in the following manner. A housing (not shown) with a keyboard on top is placed over the assembly and fastened thereto by screws or the like passing through the housing and through the assembly's apertures 60 and 13 into a support (not shown) to mount the assembly and its housing on such support. Spring conductors (not shown) in the housing pass through the assembly's apertures 61, 61' to contact the pads 22, 22' of the shield conductor 20*h* so as to electrically ground the housing to that conductor. The terminal pads 25 of the assembly 10 are electrically connected to an underlying circuit board 70 (FIG. 4) via respective edge connectors 71. Each such connector has an upper portion in the form of a "U" clip 72 which resiliently grips the front edge of assembly 10 to make ohmic contact with a corresponding terminal pad 25. The lower end of each such connector is in the form of a spade tip 73 which is inserted into a plated hole 74 in board 70 and then electrically coupled by solder 75 to the plating in such hole. In this way, the assembly 10 is electrically connected to the circuit components (not shown) on board 70.

The mentioned keyboard includes an X–Y matrix of depressible keys each centered over a respective one of the click discs 45. As a step in the operation of device 10, one of such keys is manually depressed to resiliently deflect downward the click disc 45 below it. The disc responsively touches the contact pad 21 below it so as to make an electrical connection between the row path 20 in which such pad is included and the strip 40 and column path 20 which are electrically coupled to the deflected disc. The making and subsequent breaking of such connection is communicated via the terminal pads for such paths and the edge connectors 71 for such pads to the circuit board 70 to indicate and then terminate performance of a function. For example, if assembly 10 is associated with the keyboard of a multifrequency dialing telephone set, the making and breaking of such connection will initiate and terminate the production of a multifrequency dial tone.

There will now be considered in more detail certain features of the described exemplary embodiment.

The insulating coating 35 deposited on the printed wiring board 15 has a thickness which allowably may vary between about 0.001 inch and about 0.002 inch at places where it covers the copper foil 19 on the board 15. As already described, such coating serves not only to insulate the strips 40 from the underlying electroconductive paths 20 (except for selected areas thereof) but, also as an electroplating mask whereby the copper foil 19 of such paths may have very thin layers 36 and 37 of nickel and gold plated thereon only in these selected areas. An additional function performed by coating 35 is that it elevates the bottom of the click disc strips 40 by the thickness of the coating above the top of the contact pads 21 so that, in the course of the click discs being deflected to touch these pads, the discs must pass downward beyond the bottom surface of the side portions 42, 42' of the strips 40 to undergo a negative deflection of from about 0.001 inch to about 0.002 inch. Such amount of negative deflection is desirable in that it provides optimal tactile feel consistent with maintaining contact bounce within acceptable values.

Insulating coating 35 affords the advantage, therefore, that, in association with assembly 10, that one element of the assembly performs the triple functions of insulating, serving as a plating mask, and raising the bottoms of the click disc strips above the contact pads just enough to require an optimal amount of negative deflection of the click discs in order to touch such pads. To have such an element provide all three of such functions is desirable since a considerable savings is realized thereby in time, effort and expense.

In connection with the foregoing, while the copper foil 19 in the contact pads 21 has a minimal thickness of 0.0014 inch, in practice such thickness may depart from such minimal value by a substantial relative amount as, say, 0.0004 inch. These tolerance variations (whatever their value) when added to tolerance variations in the thickness of coating 35 might, if uncorrected for, cause the negative deflection of the click discs necessary to touch the contact pads to be outside the designed permissible range for the amount of negative deflection. Such an acceptable accumulation of tolerance variations is however prevented in assembly 10 by the use of the described copper foil bars 30 on the printed wiring board 15. That is, irrespective of tolerance variations in the thickness of the copper foil 19, bars 30 will have substantially the same height above the surface of base member 16 as do the contact pads 21. Thus, the difference in height above that surface between the bottom of strips 40 and the top of the contact pads 21 will depend only on the thickness overlying bars 30 of the coating 35. Hence, by virtue of the use of bars 30, tolerance variations in the thickness of copper foil 19 are cancelled out in the determination of the amount of negative deflection to touching of the click discs. Such amount is, in other words, dependent only on the thickness of coating 35. It follows that no possibly unfortunate accumulation of tolerance variations (such as has been earlier described) can occur.

Turning now to other matters, the connection of assembly 10 to the external circuitry on board 70 via the assembly's edge terminal pads 25 and edge connectors 71 is advantageous because it permits removal of the assembly for repairs by simply detaching it from the edge connectors. That is, there is no need for unsoldering any of the assembly parts. To permit such ready detachment of assembly 10, however, it is desirable to form its terminal pads 25 (and, hence, the remainder of its electroconductive paths 20) of copper foil (rather than of electroconductive ink as was previously done) in order to provide more reliable and durable ohmic contact betwen the pads and the edge connectors. With, however, the paths 20 on the board 15 of the assembly being of copper foil and its terminal pads being dedicated to receiving the edge connectors 71, it is necessary to electromechanically connect the click disc strips 40 to the column paths 20 on the board other than by using the column terminal pads as connection sites and, preferably, without the use of solder to make the connection.

I have found it possible, despite predictions that it could not be done, to effect such electromechanical connections of strips **40*e*, 40*f*, 40*g* by, as described, including bond pads 26*e*, 26*f*, 26*g* in such paths and, further, welding the strips 40*e*, 40*f*, 40*g* at their end tabs 50*e*, 50*f*, 50*g* to such pads. Some of the considerations involved in successfully arriving at such a direct securing of the strips 40 to the printed wiring board 15** will now be discussed.

Figure 5:
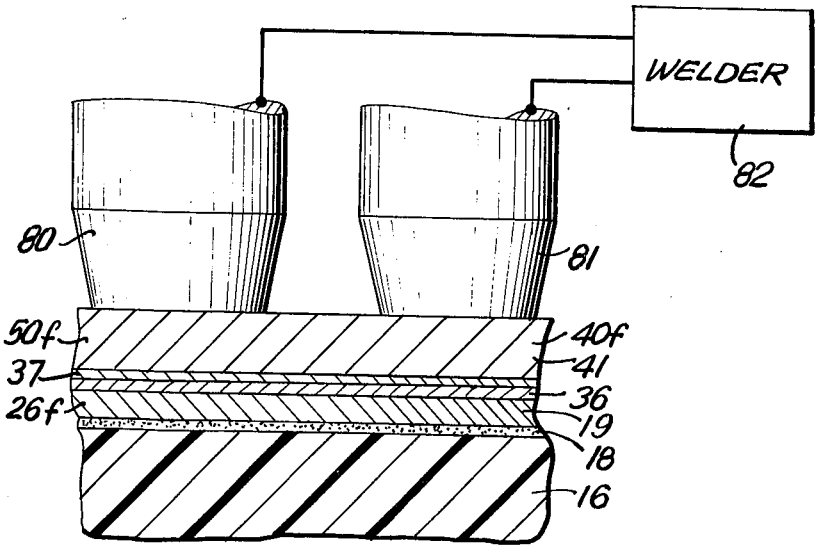
FIG. 5 is an enlarged schematic view in vertical cross section of one of the portions of the FIG. 2 assembly at which one of the column strips thereof is secured to the printed wiring board of the assembly by means including a weld junction.

FIG. 5 is a view of an enlarged manner and in vertical cross-section (with the vertical dimension being exaggerated) of the region prior to welding in which a weld junction is made between end tab 50 of strip **40*f* and bonding pad 26*f* of column row path 20*f*. It will be understood that such end tab and bonding pad extend much further out to either side of the region shown in FIG. 5** than the extent of such region itself.

To give some information relevant to FIG. 5, the copper foil 19 has a normal thickness (as stated) of 0.0014 inch, a melting point of 1980° F. and a resistivity of 1.7 microhm/cm$^3$. In contrast, the steel 41 in end tab 50 has a thickness (as stated) of about 0.0038 inch (or more than double the thickness of foil 19), a melting point of 2550° F.–2590° F. and resistivity of 72 microhm/cm$^3$. Two welding electrodes 80 and 81 are disposed in spaced relation from each other above the steel layer 41 to each contact the top surface of the layer; such electrodes being electrically connected to a welder 82. The contact faces of the electrodes each have dimensions of 0.025 inch $\times$0.025 inch, and the spacing between the electrodes is 0.015 inch. Welder 82 may be a Hughes model MCW-550 power supply, Model VTA-66 weld head, in which the constant voltage power supply has a feedback loop which dynamically controls the preset voltage across the work.

Considering the respective thicknesses, melting points and resistivities of the steel layer 41 and copper layer 19 shown in FIG. 5, it might well be thought that it would be impossible to weld such two layers together by a parallel gap welding operation in which (as shown) the two welding electrodes are both on the same side of the work. That is so because, in order to effect a weld junction of the two layers, it is necessary that material in both layers be melted to permit formation of a coalescence zinc in which the metals of both layers are fused together, but, in view of the higher melting point and resistivity of the steel than the copper, and, also, the steel's greater thickness promoting its action as a heat sink, it would be reasonable to speculate that, by the time enough welding current has flowed through the steel to raise it to melting temperature, the welding current flowing through the much lower resistivity copper would have caused it to melt and then explosively evaporate so that there would be no copper material left to fuse with the steel.

I have found, however, that, despite these apparent difficulties, satisfactory welds between the steel and copper layers can be made, and that such welds can be incorporated in junctures of the strips 40 to the printed wiring board 15 which will directly and firmly secure such strips to such board.

The welding operation is carried out in the following manner. The assembly 10 without its strips 40 and seal 55 is placed on a fixture (not shown) in the form of a flat bed having upwardly projecting aligning pins which pass through the aligning holes 14 in the assembly. The strips 40 are then placed on the assembly so that such pins also pass through the aligning holes 43 in the strips. In this connection, holes 43 may originally have been pilot holes formed in the web (i.e. continuous strip) of steel material from which the skeletons of strips 40 were punched out, and the strips then severed from the web. In such case, the pattern of location of the aligning holes 14 in board 15 is selected to match that of such pilot holes.

After the strips have been placed on the board 15 as described, the aligning pins maintain the strips in fixed longitudinal and transverse position relative to the board such that the click discs 45 of the strips are accurately centered over the contact pads 21 of the board and, also, the end tabs 50 of the strips overlie as desired the bonding pads 26 on the board. The welding electrodes 80, 81 are next placed as shown (FIG. 5) on one after another of such end tabs, and welder 82 is actuated to produce a weld of each end tab to the bonding pad which lies beneath it. For each such welding, satisfactory operating parameters for welder 82 have been found to be: voltage, 1.12 volts; weld duration, 14 milliseconds; force of the electrodes urging the assembly against the fixture, 7–8 pounds. Because in the course of welding some weld flash or weld by-products may blow out of the weld region directly in line with the gap between electrodes 80 and 81, such electrodes should be positioned on the strip 40 so as to avoid having the centerline of the electrode gap pass (as extended) close to any of the contact pads on the assembly to thereby risk fouling one or some of those by blown out material.

Figure 6:
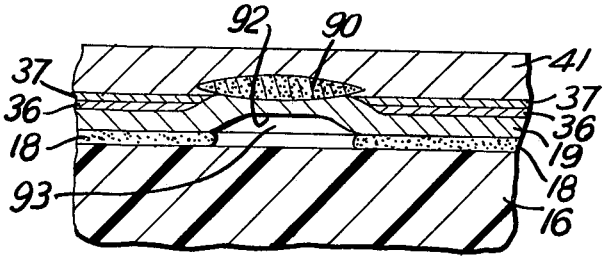
FIG. 6 is a view similar to FIG. 5 of the portion shown in FIG. 5 after such weld junction has been formed.

FIG. 6 shows the general character of the junction made between a strip 40 and the printed wiring board 15 after the welding has been completed. As indicated by that figure, the heat generated by the welding current has caused material of the steel layer 41 and of the copper foil layer 19 to become melted and fused so as to form a lenticular zone 90 of coalescensce in which material from both layers is admixed, and by which the steel and copper layers are bonded together. Beneath the weld zone 90, the thin nickel and gold platings on copper foil 19 have completely disappeared, presumably having been absorbed into the weld zone. The high temperature and heat generated by passage of the welding current through copper foil layer 19 has caused defermation of that layer such that, in the region 92 beneath zone 90, layer 19 arches up and is of decreased thickness. Also, such temperature and heat has produced under such region 92 a void region 93 within which has disappeared the adhesive layer 18 which bonds the copper foil to the base member 16 of the printed wiring board.

Void 93 has a size in its horizontal dimensions (as shown in FIG. 6) which is somewhat larger than that of weld zone 90, and which may be a substantial fraction of the width of the lead portions of the electroconductive path 20 in which the void is formed. Thus, by way of example but not restriction, zone 90 may have a linear size of about 0.025 inch, and void 93 may be about 50% larger in linear size so as to a significant fraction of the typical width of 0.050 inch for such a lead portion. It follows that an attempt to weld the steel layer 41 to such a narrow portion of copper foil would likely not result in a workable bonding of the steel to the copper because there would be insufficient copper at the sides of void 93 to secure the steel layer with adequate strength through the adhesive material 18 around the void to the base member 16 beneath. Further, none of such material may remain. Still further, the presence in such narrow portion of path of void 93 having a size substantially approaching the width of that point of the path itself might create unduly high electrical resistance in the path itself and in the connection of the steel strip to the path.

Such problems are avoided in the presently described embodiment by providing enlarged portions of the column paths 20*e*, 20*f*, 20*g* in the form of their bonding pads 26*e*, 26*f*, 26*g* through which the strips 40 are secured to the board 15. As stated, these bonding pads each have dimensions of about 0.130 inch×0.100 inch and are thus substantially greater in linear dimensioning and area than the weld zones 90 and voids 93 contained within them. Accordingly, the bonding pads provide around the voids enough copper that the electrical resistance of the connection of the strip 40 to the corresponding column path 20 is not adversely affected. Also such mass of copper is great enough that it is believed to act (possibly in conjunction with the adjacent material of steel layer 41) as a heat sink sufficient to avoid loss by explosive evaporation of all or most of the copper in region 92. Note also that the heat sink effect of the copper around void 93 prevents vaporization of the layer 18 of adhesive 18 which bonds that copper to the base member 16, and which layer has enough area to resist without rupture a substantial tensile force applied thereto. Hence, a junction of a click disc strip 40 with base member 15 which, as shown (FIG. 6) includes the weld zone 90, the copper surrounding void 93 in the bonding pad 26 and the adhesive layer 18 underlying that copper has sufficient strength to withstand a two pound pull on the click disc strip normal to the base member 16. That strength is adequate to maintain the click disc strips accurately positioned on the coating 35 of assembly 10, after 10 has been removed from the mentioned fixture and its aligning pins, and until such time as the seal 55 is added to the assembly to maintain the strips permanently fixed in position relative to the base member by the adhering of the underside of the seal both to the strips and to areas of coating 35 not covered by these strips.

In connection with the foregoing, the thickness of the copper foil layer of the conductive paths 20 is of some importance in obtaining satisfactory welds in the embodiment described of the strips 40 to the paths. More specifically, if such copper foil is too thin, it will not provide a weld with adequate strength under tension because of lack of enough tensile strength of the foil to begin with and because of loss of too much of the copper by explosive evaporation during attempted welding thereof. On the other hand, I have found that where the copper foil is two ounce copper having a nominal thickness of 0.0028 inch, satisfactory weld junctions are again not obtained, presumably because in this case the copper foil is so thick in relation to the thickness of the steel layer 41 that the copper foil acts as too much of a heat sink. Accordingly, the preferred range for the thickness of the copper foil is between a lower limit of 0.0010 inch and an upper limit of about 0.0020 inch when the steel layer (as here) has a thickness on the order of 0.004 inch.

Figure 7:
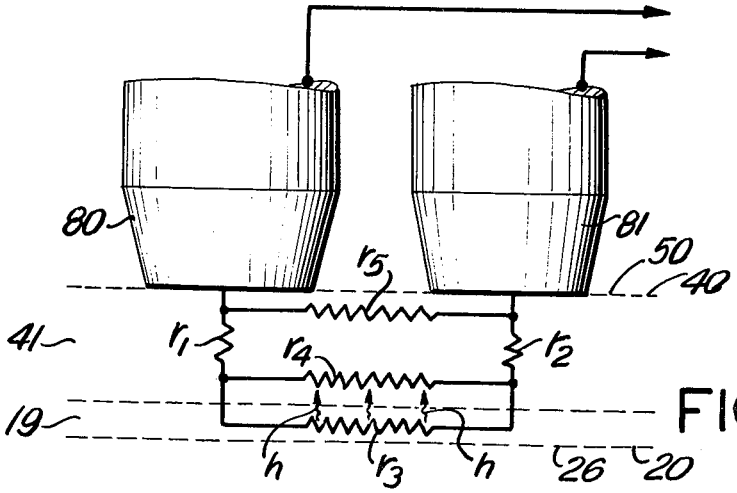
FIG. 7 is a circuit diagram illustrative of electrical conditions involved in forming the FIG. 6 junction.

Referring now to FIG. 7, an explanation of how the described steel layer 41 becomes welded to the copper foil layer 19 is as follows. In FIG. 7, the resisters $r_1$, $r_2$ represent the resistance offered to the passage of welding current from electrodes 80, 81 through layer 41 (normal to its lie) to the copper layer, the resistor $h_3$ represents the resistance offered by layer 19 to such current in flowing through 19 between these electrodes, the resistor $r_4$ represents the resistance between the electrodes of the portion of steel layer 41 adjacent to the copper foil layer 19, and the resistor $r_5$ represent the resistance between the electrodes of the remainder of the steel layer.

Now resistors $r_1$ and $r_2$ are relatively small in value because of the relatively short path lengths for current which they represent. Also resistor $r_3$ is relatively low in value because of the low resistivity of copper. On the other hand, resistors $r_4$ and $r_5$ are relatively high in value because of both the relatively long paths for current which they represent and the relatively high resistivity of steel.

As a result, when welding current flows between the electrodes 80 and 81, most of it passes through the series path $r_1$, $r_3$, $r_2$ to cause rapid heating of the copper to its melting temperature and then melting of the copper.

The remainder of the current passes through the parallel paths $r_4$ and $r_5$ but because of the relatively high resistance of such paths and the higher melting point of the steel than the copper, such current would itself likely not be capable of melting any of the steel in layer 41 before substantially all of the copper between the electrodes had been lost by explosive evaporation. However, another effect is believed to come into play, namely the flow by conduction from the copper to the steel adjacent thereto of part of the heat generated in the copper by the relatively large fraction passing therethrough of the total welding current. Such conductive heat flow is represented in FIG. 7 by arrows "h". It is believed that it is the combination of that heat flow and of the additional heating provided by passage of a minority fraction of the total welding current through the steel represented by resistor $r_4$ which is the phenomenon responsible for raising such steel above its melting temperature to permit formation of the shown weld zone 90, notwithstanding that either such heating factor would not likely of itself be capable in the circumstances of attaining such result.

While I believe the foregoing exposition to be a plausible explanation of how in the described embodiment a welding of the steel strips 40 to the copper foil paths can be realized despite the expectancy to begin with that such could not be done, of course I do not wish or intend to be bound by such particular explanation.

The above described embodiment being exemplary only, it is to be understood that additions thereto, omissions therefrom and modifications thereof can be made without departing from the spirit of the invention. Moreover, while such embodiment has been described in terms of its use as part of apparatus for obtaining multifrequency tone dialing in a telephone set, it well be appreciated that click disc assemblies in accordance with the invention may also be used in conjunction with, for example, X-Y matrix keyboards for electronic calculators, electronic computers and like apparatus.

Accordingly, the invention is not to be considered as limited save as consonant with the recitals of the following claims.

What is claimed is:

1. In a click disc switch assembly comprising: a printed wiring board including an electrically insulative base member and a plurality of first and of second electroconductive paths on such member, an array of electroconductive strips overlying such member, each such strip having an electromechanical coupling to a respective one of said second paths and having formed therein a plurality of click discs each adapted by depression to touch a respective contact pad in one of said first paths so as to electrically connect such first path through such strip to such second path respective to that strip, an insulating layer interposed between said strips and paths and having apertures for passage therethrough of said click discs, and a sealing sheet covering said strips; the improvement comprising the features that: said strips are of steel and said paths are of copper foil underlain by adhesive material bonding such foil to said base member, said second paths each include a bonding pad of such copper foil, and said electromechanical coupling of each such strip to its corresponding second path is included in a securement of such strip to said base member by a junction structure comprising: (a) a weld zone in which steel of such strip is coalesced with copper of such bonding pad of such path to weld together a layer portion of such strip and a layer portion of such copper, and which weld zone is centrally disposed within the periphery of, and substantially smaller than, such bonding pad, (b) said two layer portions so joined by said weld zone, (c) copper of said bonding pad peripherally surrounding and integral with said welded copper layer portion, and (d) adhesive material underlying such surrounding copper and bonding it to said base member.

2. An improvement according to claim 1 in which such copper foil of each such bonding pad has a thickness in a range between about 0.001 inch and 0.002 inch.

3. An improvement according to claim 2 in which such copper foil has a thickness of about 0.0014 inch.

4. An improvement according to claim 2 in which the thickness of said steel layer portion of each such strip is at least about double the thickness of the copper foil of the corresponding bonding pad.

5. An improvement according to claim 1 in which such junction structure further comprises a void region which is beneath said welded copper layer portion and extends therefrom to said base member, and which void region is bare of said adhesive material.

6. An improvement according to claim 1 in which said electroconductive paths include respective terminal pads disposed in spaced relation from each other at one edge of the base member to form an array of such pads at such edge, said bonding pads included in said second paths are disposed near said edge in inwardly spaced relation from the terminal pads of said second paths and, moreover, are joined to said terminal pads by lead portions of such paths of narrower width than the pad portions thereof, and said steel strips have end tabs overlying said bonding pads and providing by portions of said tabs said steel layer portions welded to said copper layer portions of such pads.

7. In a click disc switch assembly comprising: a printed wiring board including an electrically insulative base member and a plurality of first and of second electroconductive paths on such member, an array of electroconductive strips overlying such member, each such strip having an electromechanical coupling to a respective one of said second paths and having formed therein a plurality of click discs each adapted by depression to touch a respective contact pad in one of said first paths so as to electrically connect such first path through such strip to such second path respective to that strip, an insulating layer interposed between said strips and base member and having apertures for passage therethrough of said click discs, and a sealing sheet covering said strips; the improvement comprising the features that: said insulating layer is an originally liquid and subsequently solidified coating of insulating material deposited on said board to cover portions of said first paths while leaving uncovered the contact pads therein, said contact pads have thereon a deposit of gold while said covered portions of said first paths are bare of such gold deposit, and said strips are raised above said first paths by the interposition therebetween of such solid coating so that the amount of depression of said click discs needed for them in order to touch said contact pads is at least partly determined by the thickness of such coating.

8. An improvement according to claim 7 in which said printed wiring board includes bars thereon which are made of the same material as, but are electrically isolated from, said paths on said base member, and which bars are disposed beneath said strips adjacent said contact pads, said bars being of substantially the same thickness as said contact pads in said first paths and being covered by said coating so as to render said needed amount of depression of said click discs substantially independent of any variation in the thickness of said contact pads.

9. In a click disc switch assembly comprising: a printed wiring board including an electrically insulative base member and a plurality of first and of second electroconductive paths on such member corresponding to rows and columns, respectively, of an X–Y matrix of contact pads on said member, an array of electroconductive strips overlying such member, each such strip having an electromechanical coupling to a respective one of said second paths and having formed therein a plurality of click discs each adapted by depression to engage one such contact pad respective thereto in one of said first paths so as to electrically connect such first path through such strip to such second path respective to that strip, an insulating layer interposed between said strips and base member and having apertures for passage therethrough of said click discs, and a sealing sheet covering said strips; the improvement comprising the features that: said printing wiring board includes bars thereon which are made of the same material as, but are electrically isolated from, said paths on said base member, and which bars are disposed beneath said strips adjacent said contact pads and are covered by said insulating layer such that the height of said strips above said base member is at least partly determined both by the thickness of said bars and that of said layer, and in which said bars are of substantially the same thickness as the contact pads of said first paths such that the depression of said click discs needed to touch such pads is substantially independent in amount of any variation in the thickness of such contact pads.

10. An improvement according to claim 9 in which said bars are subdivided into bar pairs respective to such contact pads, and of which the two bars in each pair are disposed adjacent to the corresponding contact pad on opposite sides thereof to each be transected by the centerline of the matrix column in which such contact pad is included.

* * * * *